US009848653B2

(12) United States Patent
Lin

(10) Patent No.: US 9,848,653 B2
(45) Date of Patent: Dec. 26, 2017

(54) COTTON-FREE ELECTRONIC CIGARETTE, HEAT-INSULATING AND HEAT-DISSIPATING COMPONENT OF VAPORIZER DEVICE, AND METHOD FOR HEAT INSULATION AND HEAT DISSIPATION

(71) Applicant: Guangrong Lin, Guangdong (CN)

(72) Inventor: Guangrong Lin, Guangdong (CN)

( * ) Notice: Subject to any disclaimer, the term of this patent is extended or adjusted under 35 U.S.C. 154(b) by 31 days.

(21) Appl. No.: 15/037,679

(22) PCT Filed: May 26, 2014

(86) PCT No.: PCT/CN2014/078389
§ 371 (c)(1),
(2) Date: May 18, 2016

(87) PCT Pub. No.: WO2015/081667
PCT Pub. Date: Jun. 11, 2015

(65) Prior Publication Data

US 2016/0286864 A1 Oct. 6, 2016

(30) Foreign Application Priority Data

Dec. 4, 2013 (CN) ..... 2013 1 0640976

(51) Int. Cl.
*A24F 47/00* (2006.01)

(52) U.S. Cl.
CPC ..... *A24F 47/008* (2013.01)

(58) Field of Classification Search
CPC ... A24F 47/008; A61M 15/06; A61M 11/042; A61M 2205/3653; A61M 2205/8206; H02J 7/0042
(Continued)

(56) References Cited

U.S. PATENT DOCUMENTS

| | | | | |
|---|---|---|---|---|
| 9,226,526 | B2 * | 1/2016 | Liu | A24F 47/008 |
| 9,427,023 | B2 * | 8/2016 | Liu | A24F 47/002 |
| 2011/0011396 | A1 * | 1/2011 | Fang | A24F 47/008 128/202.21 |
| 2013/0192618 | A1 * | 8/2013 | Li | A24F 47/008 131/329 |

(Continued)

FOREIGN PATENT DOCUMENTS

| | | | |
|---|---|---|---|
| CN | 201238610 | Y | 5/2009 |
| CN | 102326869 | A | 1/2012 |

(Continued)

OTHER PUBLICATIONS

International Search Report of PCT Patent Application No. PCT/CN2014/078389 dated Sep. 3, 2014.

(Continued)

*Primary Examiner* — Harshad C Patel

(57) ABSTRACT

Disclosed is a cotton-free electronic cigarette, a heat-insulating and heat-dissipating component of a vaporizer device of the cotton-free electronic cigarette, and a method for heat insulation and heat dissipation. The heat-insulating and heat-dissipating component consists of a heat insulation sleeve and a vapor flow passage. The heat insulation sleeve is provided inside an outer pipe and outside a vaporizer unit. The heat insulation sleeve, the outer pipe and the vaporizer unit have a same central longitudinal axis. A method for heat insulation and heat dissipation of the cotton-free electronic cigarette comprises: dissipating heat generated from the vaporizer unit along the vapor flow passage formed between an exterior longitudinal flat surface of a liquid storage cup and the heat insulation sleeve, and discharging the heat outside the cotton-free electronic cigarette through thermal conductivity of the heat insulation sleeve.

8 Claims, 4 Drawing Sheets

(58) Field of Classification Search
USPC ..... 131/329, 360, 236, 328
See application file for complete search history.

(56) References Cited

U.S. PATENT DOCUMENTS

| | | | | |
|---|---|---|---|---|
| 2014/0196734 | A1* | 7/2014 | Liu | A24F 47/008 131/329 |
| 2014/0290677 | A1* | 10/2014 | Liu | A61M 15/06 131/329 |
| 2014/0318558 | A1* | 10/2014 | Liu | A24F 47/002 131/329 |
| 2015/0128970 | A1* | 5/2015 | Liu | A24F 47/008 131/329 |

FOREIGN PATENT DOCUMENTS

| | | | |
|---|---|---|---|
| CN | 102379458 | A | 3/2012 |
| CN | 202168452 | U | 3/2012 |
| CN | 103653259 | A | 3/2014 |
| CN | 103653260 | A | 3/2014 |
| CN | 203563694 | U | 4/2014 |
| CN | 203563695 | U | 4/2014 |
| CN | 203563696 | U | 4/2014 |
| WO | 2013089551 | A1 | 6/2013 |

OTHER PUBLICATIONS

2nd Office Action of counterpart Chinese Patent Application No. 201310640976.0 dated May 13, 2016.

* cited by examiner

COTTON-FREE ELECTRONIC CIGARETTE, HEAT-INSULATING AND HEAT-DISSIPATING COMPONENT OF VAPORIZER DEVICE, AND METHOD FOR HEAT INSULATION AND HEAT DISSIPATION

FIELD OF THE INVENTION

The present invention relates to a cotton-free electronic cigarette, a heat-insulating and heat-dissipating component of a vaporizer device of a cotton-free electronic cigarette, and a method for heat insulation and heat dissipation.

BACKGROUND OF THE INVENTION

Existing electronic cigarettes are usually made of plastic materials without using any overheat protection device. As a result, when a vaporizer unit works to generate heat, the vaporizer unit itself and other components of the existing electronic cigarettes are easily damaged by the heat.

SUMMARY OF THE INVENTION

The present invention aims to provide a cotton-free electronic cigarette, which is able to effectively insulate heat generated from a working vaporizer unit so as to prevent an outer pipe and internal components of the cotton-free electronic cigarette from being heat-damaged. The present invention also aims to provide a heat-insulating and heat-dissipating component, which is able to effectively lower the temperature of a vapor flow passage of a cotton-free electronic cigarette so as to prevent an outer pipe and internal components of the cotton-free electronic cigarette from being heat-damaged. Another object of the present invention is to provide a method for heat insulation and heat dissipation of a cotton-free electronic cigarette.

A first technical solution of the present invention is a heat-insulating and heat-dissipating component of a vaporizer device of a cotton-free electronic cigarette, wherein a heat insulation sleeve is provided inside an outer pipe and outside a vaporizer unit; the heat insulation sleeve, the outer pipe and the vaporizer unit have a same central longitudinal axis.

Preferably, the heat insulation sleeve is arranged inside the outer pipe and outside a liquid storage cup, a circumferential protrusion of a supporting frame and a power connecting assembly that are received in the outer pipe; the heat insulation sleeve starts from the position of a liquid percolation piece of the vaporizer device and terminates at the position of the power connecting assembly; the heat insulation sleeve, the outer pipe, the liquid storage cup, the circumferential protrusion of the supporting frame, the power connecting assembly, and the liquid percolation piece of the vaporizer device have the same central longitudinal axis.

Preferably, the heat insulation sleeve separates the vaporizer unit from the outer pipe; the heat insulation sleeve and the power connecting assembly dissipate a part of the heat generated from the vaporizer unit to prevent the outer pipe and components in the outer pipe from being heat-damaged, so as to lower the temperature of a vapor flow passage of the cotton-free electronic cigarette and thereby preventing overheat of the cotton-free electronic cigarette.

Preferably, the heat insulation sleeve is made of metal or made of heat-resistant nonmetallic material.

Preferably, heat generated from the vaporizer unit is discharged outside the cotton-free electronic cigarette through thermal conductivity of the heat insulation sleeve.

A second technical solution of the present invention is a cotton-free electronic cigarette comprising a power supply assembly, a power connecting assembly, a vaporizer device and a liquid storage assembly that are successively connected, wherein the cotton-free electronic cigarette comprises the above-mentioned heat-insulating and heat-dissipating component.

A third technical solution of the present invention is a heat-insulating and heat-dissipating component of a vaporizer device of a cotton-free electronic cigarette, wherein a heat insulation sleeve is provided inside an outer pipe and outside a vaporizer unit; the heat insulation sleeve, the outer pipe and the vaporizer unit have a same central longitudinal axis; a liquid storage cup has an exterior longitudinal flat surface, a vapor flow passage is formed between the exterior longitudinal flat surface and the heat insulation sleeve.

In a fourth technical solution of the present invention, the heat insulation sleeve is arranged inside the outer pipe and outside the liquid storage cup, a circumferential protrusion of a supporting frame and a power connecting assembly that are received in the outer pipe; the heat insulation sleeve starts from the position of a liquid percolation piece of the vaporizer device and terminates at the position of the power connecting assembly; the heat insulation sleeve, the outer pipe, the liquid storage cup, the circumferential protrusion of the supporting frame, the power connecting assembly, and the liquid percolation piece of the vaporizer device have the same central longitudinal axis.

Preferably, heat generated from the vaporizer unit is dissipated along the vapor flow passage formed between the exterior longitudinal flat surface and the heat insulation sleeve, and then the heat is discharged outside the cotton-free electronic cigarette through thermal conductivity of the heat insulation sleeve.

A fifth technical solution of the present invention is a cotton-free electronic cigarette comprising a power supply assembly, a power connecting assembly, a vaporizer device and a liquid storage assembly that are successively connected, wherein the cotton-free electronic cigarette comprises the above-mentioned heat-insulating and heat-dissipating component.

The technical solutions of the present invention have the following advantages. Firstly, the heat insulation sleeve is arranged inside the outer pipe and outside the liquid storage cup, the circumferential protrusion of the supporting frame and the fixation seat that are received in the outer pipe. Heat generated from the vaporizer unit is discharged outside the outer pipe through the heat insulation sleeve, thereby preventing the outer pipe and the internal components from being heat-damaged by a hot vaporizer unit.

Secondly, the heat insulation sleeve separates the vaporizer unit from the outer pipe, thus preventing the outer pipe and the internal components from being heat-damaged by a hot vaporizer unit.

Thirdly, most of heat generated inside the cotton-free electronic cigarette can be discharged outside the cotton-free electronic cigarette through the vapor flow passage formed between the exterior longitudinal flat surface of the liquid storage cup and the heat insulation sleeve.

Fourthly, because the outer pipe and the internal components are protected from overheat by the heat-insulating and heat-dissipating component of the cotton-free electronic cigarette of the present invention, the safety, hygiene and reliability of the cotton-free electronic cigarette of the present invention are largely improved.

LIST OF REFERENCE NUMERALS OF MAIN COMPONENTS

Figure 1:
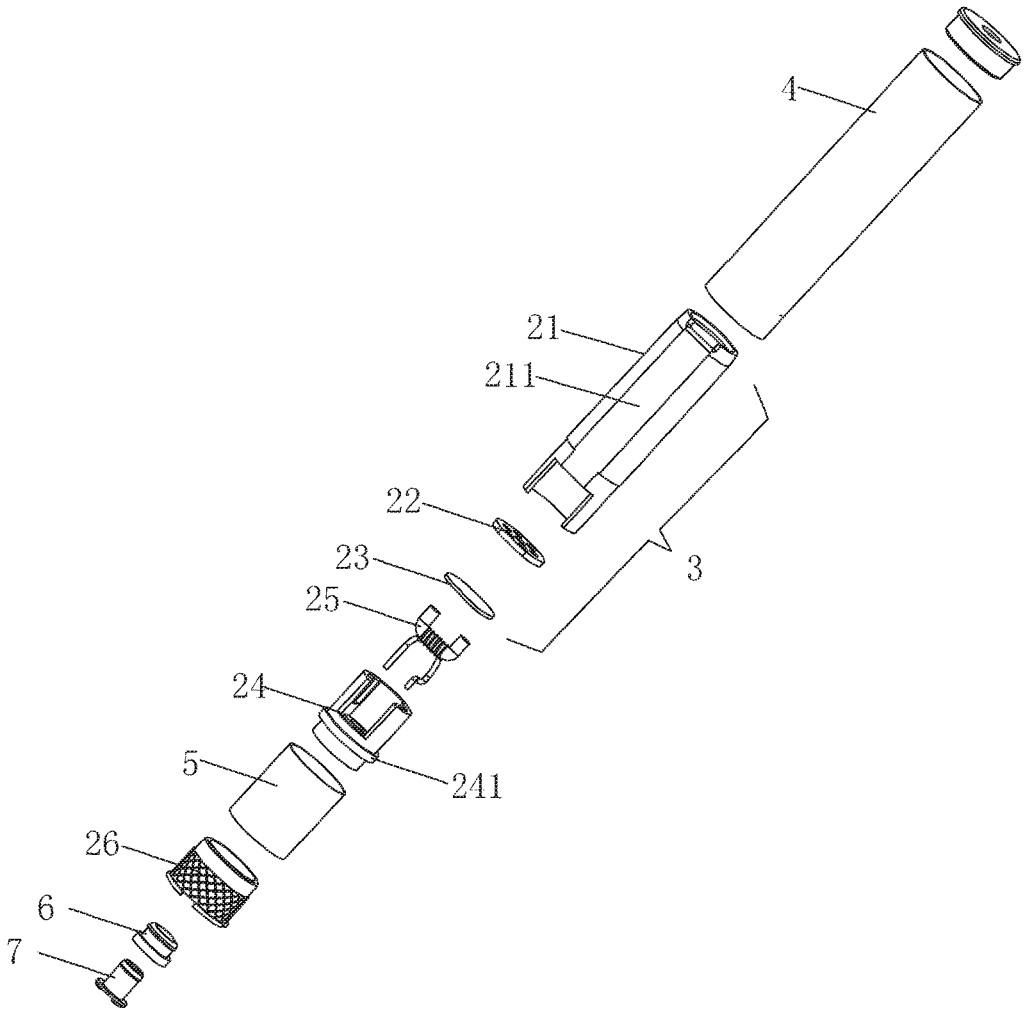
FIG. 1 is a perspective exploded view of a cotton-free electronic cigarette according to a first embodiment of the present invention.

1 power supply assembly
2 vaporizer device
21 liquid storage cup
211 exterior longitudinal flat surface
22 liquid percolation piece
23 filter piece
24 supporting frame
241 circumferential protrusion
25 vaporizer unit
26 fixation seat
261 sleeve
262 separation plate
2621 through hole
263 mounting groove
264 sealing ring
3 liquid storage assembly
4 outer pipe
5 heat insulation sleeve
6 electrical insulation ring
7 positive needle electrode

DETAILED DESCRIPTION OF ILLUSTRATED EMBODIMENTS

Various preferred embodiments will now be described with reference to the figures.

Figure 2:
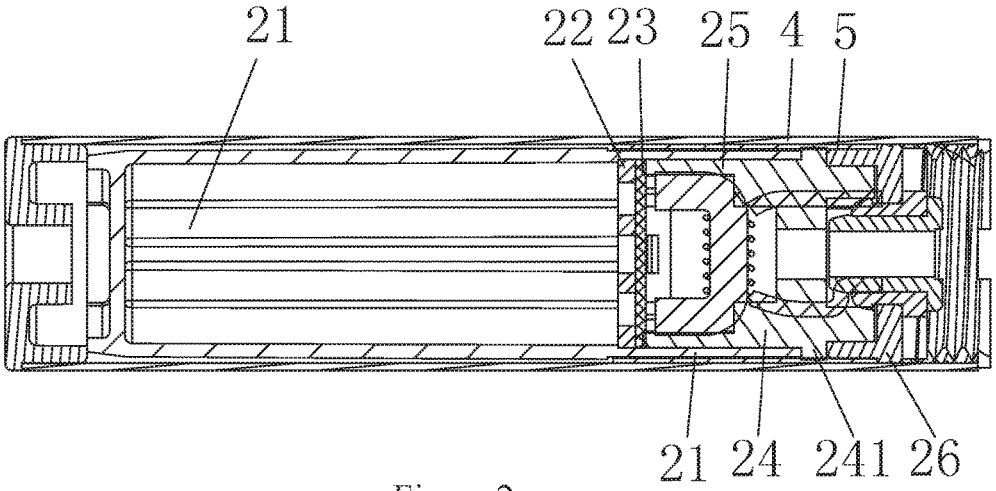
FIG. 2 is a cross-sectional view of an assembled cotton-free electronic cigarette shown in FIG. 1.
Figure 3:
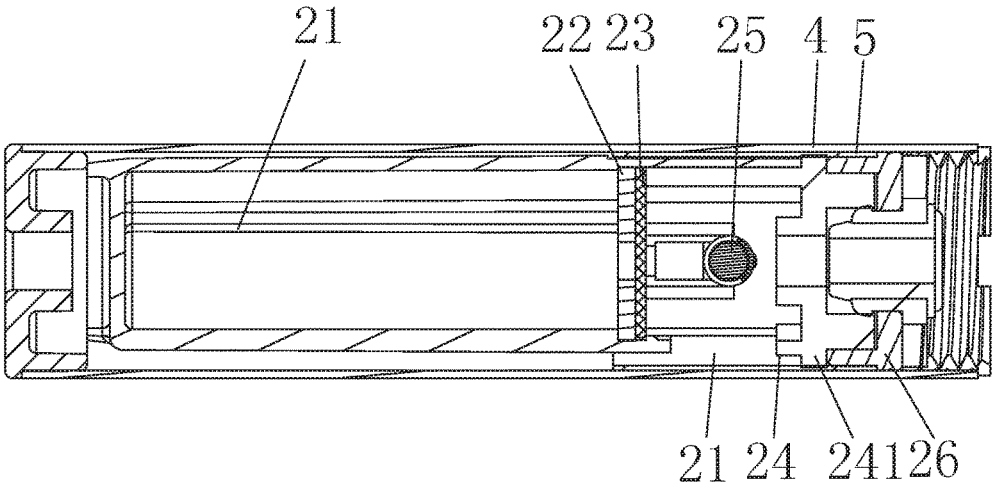
FIG. 3 is another cross-sectional view of an assembled cotton-free electronic cigarette shown in FIG. 1.

FIGS. 1-3 show a first embodiment of a cotton-free electronic cigarette of the present invention.

Referring to FIGS. 1-3, the cotton-free electronic cigarette comprises a power supply assembly (not shown in FIGS. 1-3), a power connecting assembly, a vaporizer device and a liquid storage assembly 3; wherein the power supply assembly and the liquid storage assembly 3 are common knowledge in the art.

In this embodiment, the vaporizer device of cotton-free electronic cigarette consists of:

a liquid storage cup 21, a liquid percolation piece 22 and a filter piece 23 that are respectively inserted into an opening end of the liquid storage cup 21, a supporting frame 24 arranged at the opening end of the liquid storage cup 21, a vaporizer unit 25 fitted into two longitudinal insertion slots of the supporting frame 24, an outer pipe 4, and a heat insulation sleeve 5.

A circumferential protrusion 241 is protruded from a circumference of the supporting frame 24, one side of the circumferential protrusion 241 is sheathed with the liquid storage cup 21, the other side of the circumferential protrusion 241 is sheathed with a fixation seat 26.

The liquid storage cup 21, the circumferential protrusion 241 and the fixation seat 26 are successively arranged in the outer pipe 4. The heat insulation sleeve 5 has a good thermal conductivity and heat-resistant performance. The heat insulation sleeve 5 is arranged inside the outer pipe 4 and outside the liquid storage cup 21, the circumferential protrusion 241 and the fixation seat 26; the heat insulation sleeve 5 starts from the position of the liquid percolation piece 22 and terminates at the position of the fixation seat 26.

The outer pipe 4, the heat insulation sleeve 5, the liquid storage cup 21, the circumferential protrusion 241 of the supporting frame 24 and the fixation seat 26 have a same central longitudinal axis.

In this embodiment, the power connecting assembly consists of the fixation seat 26, an electrical insulation ring 6 sheathed with the fixation seat 26, and a positive needle electrode 7 sheathed with the electrical insulation ring 6; wherein the fixation seat 26 is made of metal with a screw thread, or the fixation seat 26 is made of magnetic metal, or the fixation seat 26 is made of nonmetallic material with a connecting electrode.

In this embodiment, the heat insulation sleeve 5 is made of steel. Alternatively, the heat insulation sleeve 5 is made of metal other than steel, or the heat insulation sleeve 5 is made of heat-resistant nonmetallic material.

In this embodiment, the liquid storage cup 21 has an exterior longitudinal flat surface 211, a vapor flow passage is formed between the exterior longitudinal flat surface 211 and the heat insulation sleeve 5.

In this embodiment, a method for heat insulation and heat dissipation of the cotton-free electronic cigarette comprises: dissipating heat generated from the vaporizer unit 25 along the vapor flow passage formed between the exterior longitudinal flat surface 211 and the heat insulation sleeve 5, and discharging a part of the heat outside the cotton-free electronic cigarette through thermal conductivity of the heat insulation sleeve 5.

Figure 4:
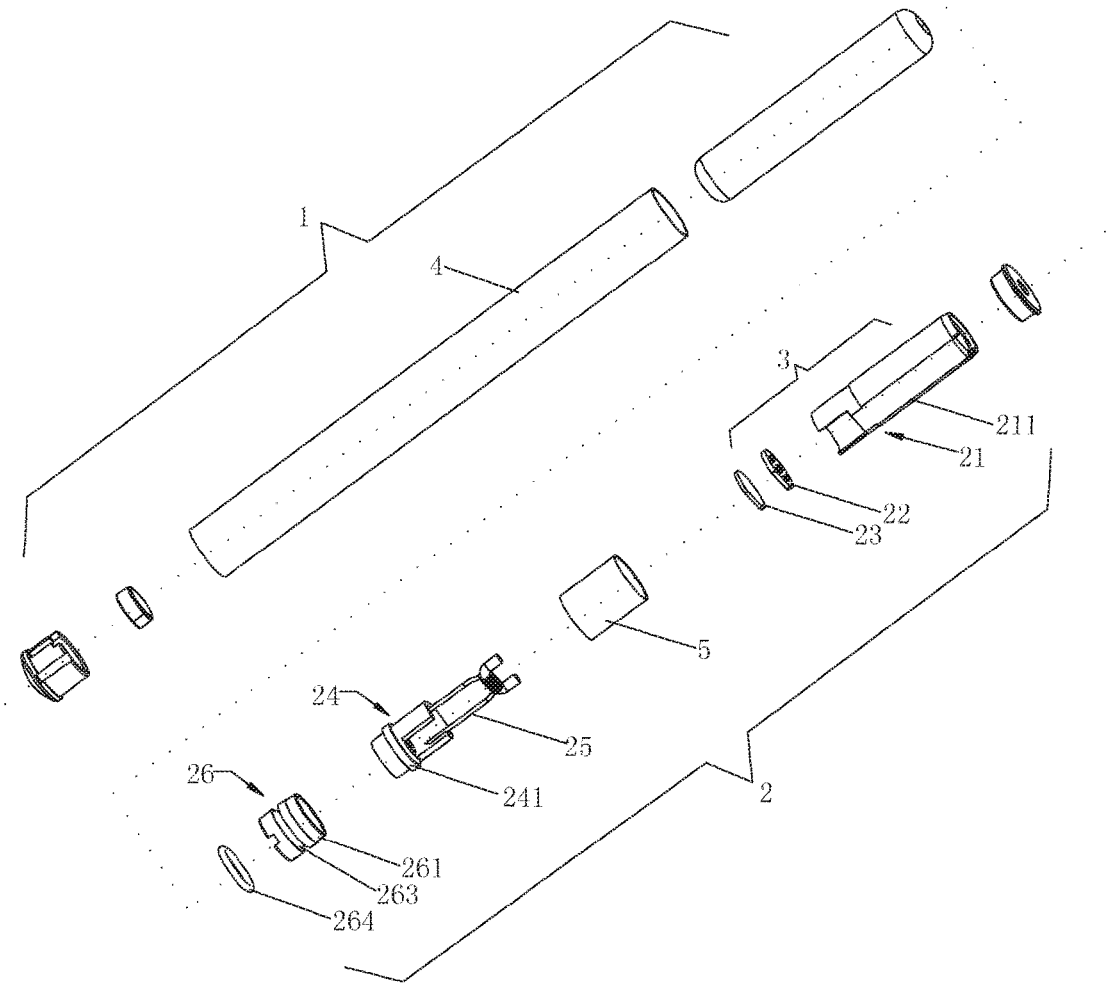
FIG. 4 is a perspective exploded view of a disposable cotton-free electronic cigarette according to a second embodiment of the present invention.
Figure 5:
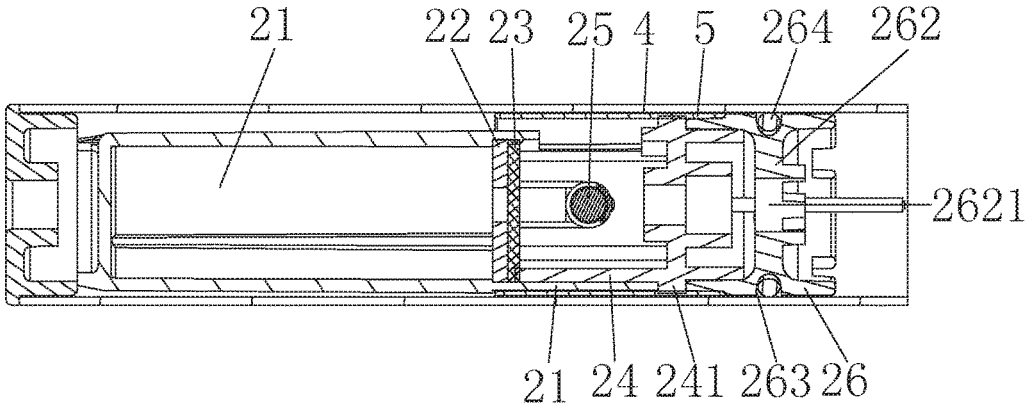
FIG. 5 is a cross-sectional view of an assembled disposable cotton-free electronic cigarette shown in FIG. 4.
Figure 6:
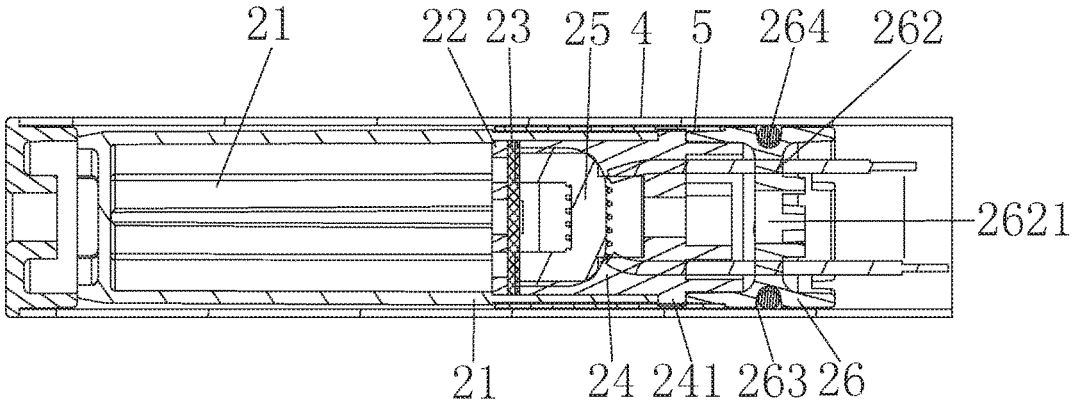
FIG. 6 is another cross-sectional view of an assembled disposable cotton-free electronic cigarette shown in FIG. 4.

FIGS. 4-6 show a second embodiment of a cotton-free electronic cigarette of the present invention.

Referring to FIGS. 4-6, the cotton-free electronic cigarette comprises a power supply assembly 1, a power connecting assembly, a vaporizer device 2 and a liquid storage assembly 3; wherein the power supply assembly 1 and the liquid storage assembly 3 are common knowledge in the art.

In this embodiment, the vaporizer device 2 consists of:

a liquid storage cup 21, a liquid percolation piece 22 and a filter piece 23 that are inserted into an opening end of the liquid storage cup 21;

a supporting frame 24 arranged at the opening end of the liquid storage cup 21, a vaporizer unit 25 fitted into two longitudinal insertion slots of the supporting frame 24, a fixation seat 26, and a heat insulation sleeve 5.

A circumferential protrusion 241 is protruded from a circumference of the supporting frame 24, one side of the circumferential protrusion 241 is sheathed with the liquid storage cup 21, the other side of the circumferential protrusion 241 is sheathed with the fixation seat 26.

The liquid storage cup 21, the circumferential protrusion 241 of the supporting frame 24 and the fixation seat 26 are successively arranged in an outer pipe 4. The heat insulation sleeve 5 has a good thermal conductivity and heat-resistant performance. The heat insulation sleeve 5 is arranged inside the outer pipe 4 and outside the liquid storage cup 21, the circumferential protrusion 241 and the fixation seat 26; the heat insulation sleeve 5 starts from the position of the liquid percolation piece 22 and terminates at the position of the fixation seat 26.

The outer pipe 4, the heat insulation sleeve 5, the liquid storage cup 21, the circumferential protrusion 241 and the fixation seat 26 have a same central longitudinal axis.

In this embodiment, the heat insulation sleeve 5 is made of steel. Alternatively, the heat insulation sleeve 5 is made of heat-resistant nonmetallic material, such as ceramics, ceramic fiber, glass, and glass fiber.

In this embodiment, the liquid storage cup 21 has an exterior longitudinal flat surface 211, a vapor flow passage is formed between the exterior longitudinal flat surface 211 and the heat insulation sleeve 5.

In this embodiment, the power connecting assembly consists of the fixation seat 26; wherein the fixation seat 26 is made of metal with a screw thread, or the fixation seat 26 is made of magnetic metal, or the fixation seat 26 is made of nonmetallic material with a connecting electrode. The fixation seat 26 consists of: a sleeve 261, a separation plate 262 transversely positioned in the middle of the sleeve 261, two cylindrical chambers respectively formed at two sides of the separation plate 262, a through hole 2621 opened in the middle of the separation plate 262 and interconnected to the two cylindrical chambers, and a mounting groove 263 radially concaved from an external surface of the sleeve 261 at the position of the separation plate 262, the mounting groove 263 being configured to be sleeved with a sealing ring 264.

In this embodiment, a method for heat insulation and heat dissipation of the cotton-free electronic cigarette comprises: dissipating heat generated from the vaporizer unit 25 along the vapor flow passage formed between the exterior longitudinal flat surface 211 and the heat insulation sleeve 5, and discharging a part of the heat outside the cotton-free electronic cigarette through thermal conductivity of the heat insulation sleeve 5.

All the above are the preferred embodiments of the present invention, and the invention is intended to cover various modifications and equivalent arrangements included within the scope of the invention.

What is claimed is:

1. A heat-insulating and heat-dissipating component of a vaporizer device of a cotton-free electronic cigarette, characterized in that a heat insulation sleeve is provided inside an outer pipe and outside a vaporizer unit; the heat insulation sleeve, the outer pipe and the vaporizer unit have a same central longitudinal axis; and the heat insulation sleeve is arranged inside the outer pipe and outside a liquid storage cup, a circumferential protrusion of a supporting frame and a power connecting assembly that are received in the outer pipe;

the heat insulation sleeve starts from a position of a liquid percolation piece of the vaporizer device and terminates at a position of the power connecting assembly;

the heat insulation sleeve, the outer pipe, the liquid storage cup, the circumferential protrusion of the supporting frame, the power connecting assembly, and the liquid percolation piece of the vaporizer device have the same central longitudinal axis.

2. The heat-insulating and heat-dissipating component of the vaporizer device of the cotton-free electronic cigarette of claim 1, characterized in that the heat insulation sleeve separates the vaporizer unit from the outer pipe; the heat insulation sleeve and the power connecting assembly dissipate a part of the heat generated from the vaporizer unit to prevent the outer pipe and components in the outer pipe from being heat-damaged, so as to lower the temperature of a vapor flow passage of the cotton-free electronic cigarette and thereby preventing overheat of the cotton-free electronic cigarette.

3. A cotton-free electronic cigarette comprising a power supply assembly, a power connecting assembly, a vaporizer device and a liquid storage assembly that are successively connected, characterized in that the cotton-free electronic cigarette comprises the heat-insulating and heat-dissipating component of claim 2.

4. The heat-insulating and heat-dissipating component of the vaporizer device of the cotton-free electronic cigarette of claim 1, characterized in that the heat insulation sleeve is made of metal or made of heat-resistant nonmetallic material.

5. A cotton-free electronic cigarette comprising a power supply assembly, a power connecting assembly, a vaporizer device and a liquid storage assembly that are successively connected, characterized in that the cotton-free electronic cigarette comprises the heat-insulating and heat-dissipating component of claim 4.

6. A cotton-free electronic cigarette comprising a power supply assembly, a power connecting assembly, a vaporizer device and a liquid storage assembly that are successively connected, characterized in that the cotton-free electronic cigarette comprises the heat-insulating and heat-dissipating component of claim 1.

7. A heat-insulating and heat-dissipating component of a vaporizer device of a cotton-free electronic cigarette, characterized in that:

a heat insulation sleeve is provided inside an outer pipe and outside a vaporizer unit;

the heat insulation sleeve, the outer pipe and the vaporizer unit have a same central longitudinal axis;

a liquid storage cup has an exterior longitudinal flat surface, a vapor flow passage is formed between the exterior longitudinal flat surface and the heat insulation sleeve; and the heat insulation sleeve is arranged inside the outer pipe and outside the liquid storage cup, a circumferential protrusion of a supporting frame and a power connecting assembly that are received in the outer pipe;

the heat insulation sleeve starts from a position of a liquid percolation piece of the vaporizer device and terminates at a position of the power connecting assembly;

the heat insulation sleeve, the outer pipe, the liquid storage cup, the circumferential protrusion of the supporting frame, the power connecting assembly, and the liquid percolation piece of the vaporizer device have the same central longitudinal axis.

8. A cotton-free electronic cigarette comprising a power supply assembly, a power connecting assembly, a vaporizer device and a liquid storage assembly that are successively connected, characterized in that the cotton-free electronic cigarette comprises the heat-insulating and heat-dissipating component of claim 7.

* * * * *